US005794919A

United States Patent [19]

Hauck

[11] Patent Number: 5,794,919

[45] Date of Patent: Aug. 18, 1998

[54] COMPACT POWER HOIST

[75] Inventor: Chester J. Hauck, Columbus, Ohio

[73] Assignee: Aqua Marine Supply, Millersport, Ohio

[21] Appl. No.: 806,740

[22] Filed: Feb. 27, 1997

Related U.S. Application Data

[60] Provisional application No. 60/032,869 Dec. 13, 1996.

[51] Int. Cl. [6] ..... B66D 1/00

[52] U.S. Cl. ..... 254/343; 254/362

[58] Field of Search ..... 254/343, 362

[56] References Cited

U.S. PATENT DOCUMENTS

| | | | |
|---|---|---|---|
| 1,739,353 | 12/1929 | Criteser | 254/362 |
| 2,662,733 | 12/1953 | Allenbaugh | 254/343 |
| 2,771,268 | 11/1956 | Rosewall | 254/343 |
| 3,117,767 | 1/1964 | McLean et al. | 254/362 |
| 3,467,359 | 9/1969 | Durand | 254/343 |
| 3,474,922 | 10/1969 | Wood et al. | 254/362 |
| 3,640,506 | 2/1972 | Durand . | |
| 3,876,183 | 4/1975 | Strout et al. . | |
| 3,876,184 | 4/1975 | Eudy . | |
| 4,132,322 | 1/1979 | Loesch et al. . | |
| 4,215,850 | 8/1980 | Haase et al. . | |
| 4,613,273 | 9/1986 | Wagner | 254/362 |
| 4,666,102 | 5/1987 | Colbaugh et al. . | |
| 4,884,784 | 12/1989 | Nix et al. . | |
| 4,909,482 | 3/1990 | Hofmann et al. . | |
| 5,287,821 | 2/1994 | Godbersen . | |

*Primary Examiner*—Katherine Matecki
*Attorney, Agent, or Firm*—Frank H. Foster; Kremblas, Foster, Millard & Pollick

[57] ABSTRACT

A compact, motorized hoist including a U-shaped member, the open end of which is rigidly fastened to a first leg of an L-shaped member. The support panel leg of the L-shaped member extends across the open side of the U-shaped member. An electric motor is rigidly fastened to the support panel leg of the L-shaped member and is drivingly linked to a worm gear shaft extending through a gap between the support panel leg of the L-shaped member and the open side of the U-shaped member. The worm gear shaft is journalled to the L-shaped member. The worm gear drives a first gear having an axle mounted perpendicular to the first leg of the L-shaped member, and the closed end of the U-shaped member. A cable is wound around a reel rigidly mounted to the axle. The L-shaped member is removably fastened to the U-shaped member, and one leg of the U-shaped member is removably fastened to a pier member.

8 Claims, 4 Drawing Sheets

COMPACT POWER HOIST

This application claims the benefits of U.S. Provisional application No. 60/032,869 filed Dec. 13, 1996.

TECHNICAL FIELD

The invention relates broadly to the field of hoists, such as for raising and lowering watercraft out from and into water, and more specifically to compact, powered hoists.

BACKGROUND ART

Watercraft must be transferred to and from bodies of water for repair, storage, etc. Devices used to assist a person in lifting or lowering the watercraft include large, hand-cranked wheels, and electric motor powered winches. There is an extremely wide variety of designs and configurations of hoists. Many of these hoists are cumbersome and difficult to assemble and disassemble, such as Godbersen's U.S. Pat. No. 5,287,821. Others are complex, such as Haase et al., U.S. Pat. No. 4,215,850 and Hofmann et al., U.S. Pat. No. 4,909,482. See also Nix et al. in U.S. Pat. No. 4,884,784, Colbaugh et al. in U.S. Pat. No. 4,666,102, Loesch et al. in U.S. Pat. No. 4,132,322, Eudy's U.S. Pat. No. 3,876,184, Strout et al. in U.S. Pat. No. 3,876,183, and Durand's U.S. Pat. No. 3,640,506.

There is no prior art hoist having a combination of structures to form a hoist which is strong and compact, and yet also easily assembled and disassembled. Therefore, the need exists for a compact hoist having these characteristics.

BRIEF DISCLOSURE OF INVENTION

The invention is a compact hoist comprising a U-shaped support housing member formed by first and second legs connected by a third leg. An L-shaped support housing member has a first leg fastened across the legs of the U-shaped member at its open end. The L-shaped member also has a second leg extending along an open side of the U-shaped member. A reel and a first gear are fixed to an axle extending between and generally parallel to the first and second legs of the U-shaped member. The axle is journalled to, and substantially perpendicular to, the first leg of the L-shaped member and the third leg of the U-shaped member. A worm gear is journalled to the L-shaped member and meshes with the first gear. A rotary motor is mounted to the L-shaped member and is drivingly linked to the worm gear.

Figure 1:
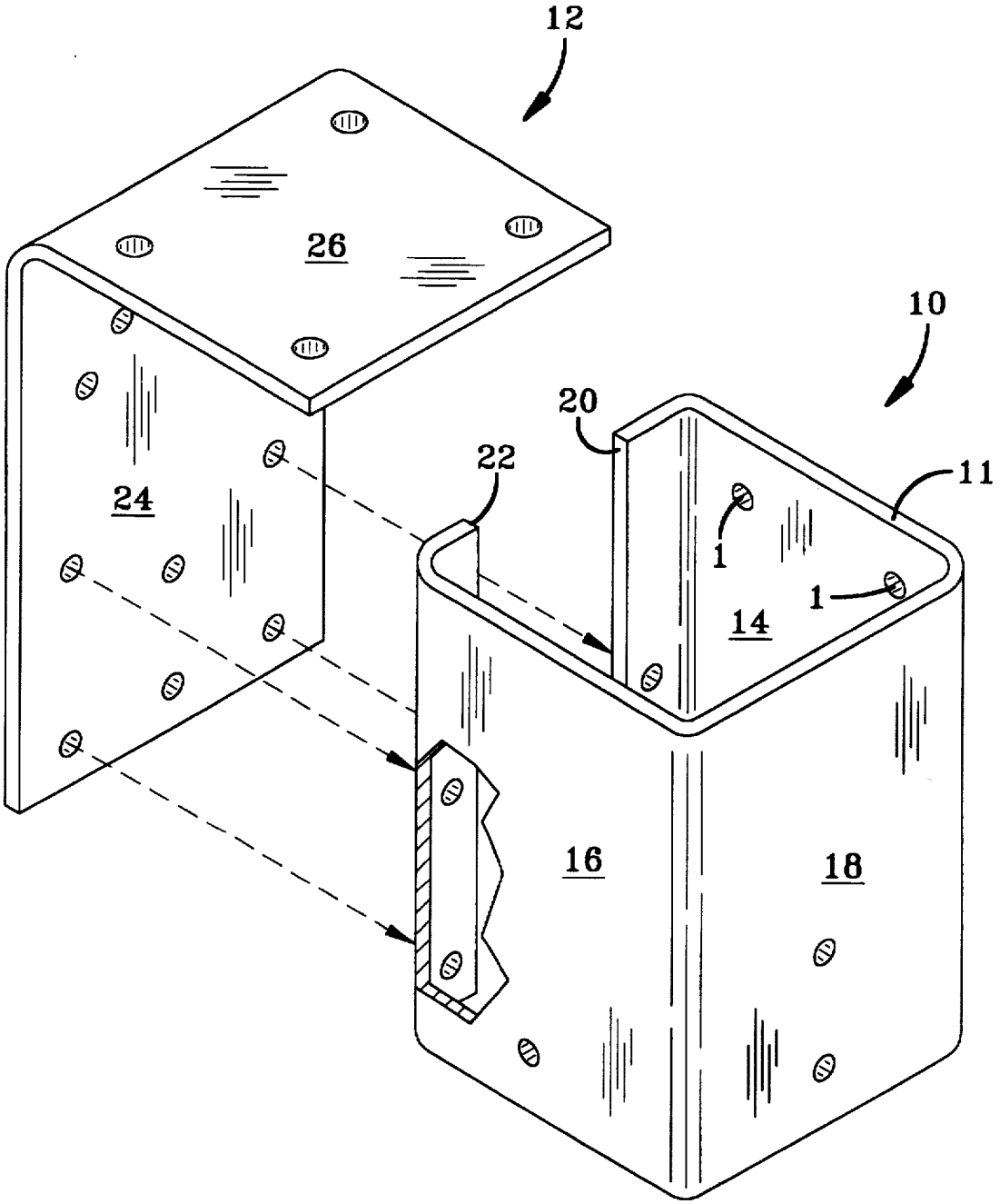
FIG. 1 is a view in perspective illustrating the preferred support housing members.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

The preferred support housing of the hoist is shown in FIG. 1, including a U-shaped support housing member 10 and an L-shaped support housing member 12. The U-shaped member 10 has a first leg 14, a second leg 16, and a third leg 18 which connects the first and second legs 14 and 16. The legs 14 and 16 are preferably substantially parallel, although they could be positioned at an angle relative to one another. The legs 14, 16 and 18 are preferably planar, although they could be curved, corrugated or otherwise shaped for strength or attachment purposes. Inwardly turned lips 20 and 22 are formed at the free end of each of the first and second legs 14 and 16, respectively.

The L-shaped member 12 has a first leg 24 which attaches to the lips 20 and 22 of the U-shaped member 10. When attached, the first leg 24 closes the open end of the U-shaped member 10. A second L-shaped member leg, preferably the support panel leg 26, extends across the open side of the U-shaped member 10, which is the top opening of the U-shaped member 10 in the orientation shown in FIG. 1. A gap is formed between the support panel leg 26 and the upper edge 11 of the U-shaped member 10.

When assembled, the U-shaped member 10 and the L-shaped member 12 form a support housing to which, and within which, the moving parts of the hoist are attached. One leg of the support housing is preferably removably fastened to a dock or a pier, or some other structure rigidly grounded. The support housing contains a rectangular cylinder formed by the legs of the U-shaped member and the attached leg of the L-shaped member. This rectangular cylinder has the structural characteristics of a box-beam, and therefore could alternatively be a unitary structure rather than the separable members making up the preferred configuration. The preferred two-piece support housing functions, when assembled, like a box-beam, but has the advantage that it can be disassembled for easier access to the interior space. In its assembled state, the preferred, two-piece embodiment retains the principle of the broad invention, which is a rectangular cylinder support housing in which and to which the mechanical parts are mounted, and has the advantage of easy access to many of the mechanical parts.

Figure 2:
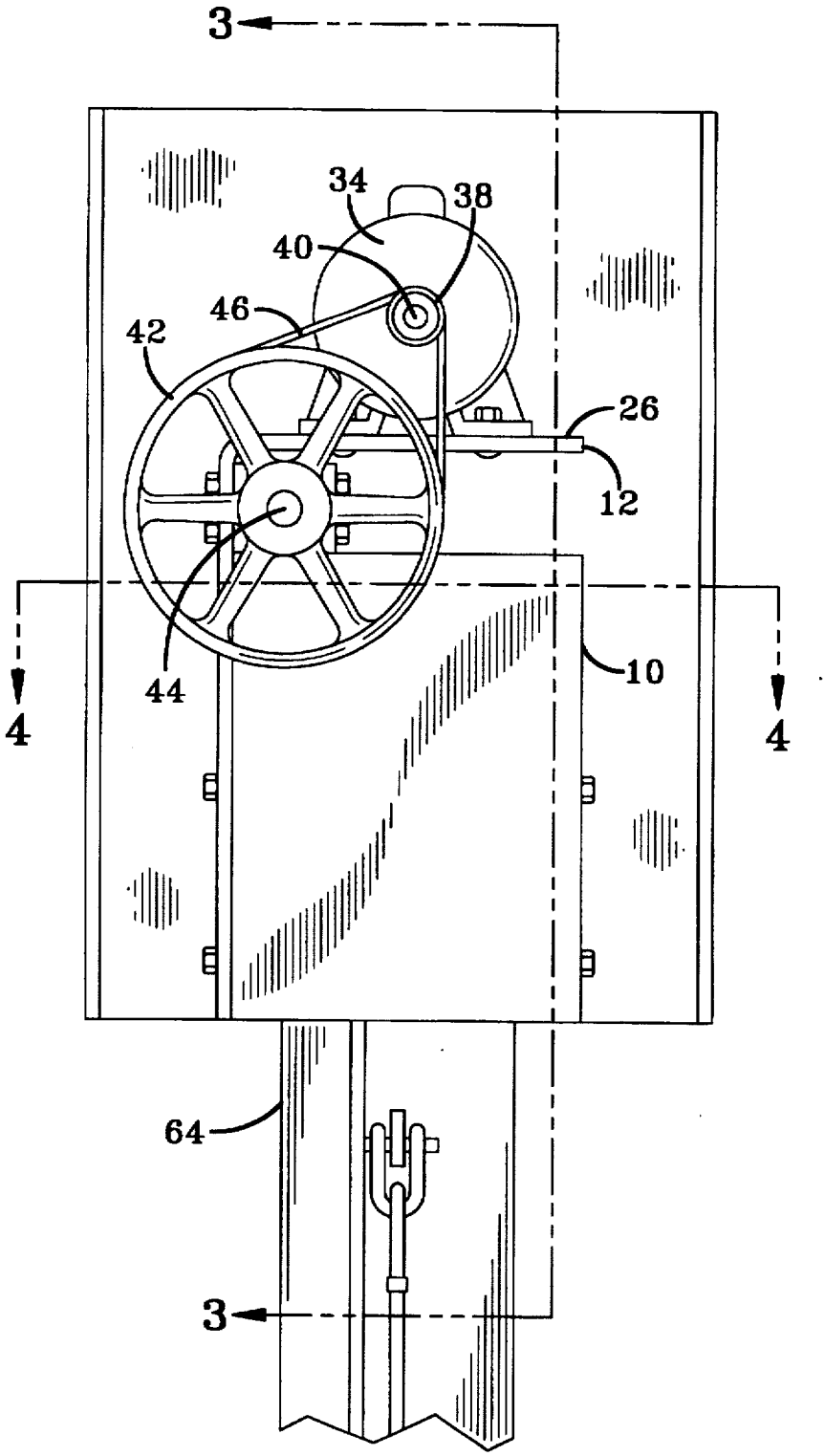
FIG. 2 is a side view illustrating the preferred embodiment of the present invention.

In FIG. 2, the L-shaped member 12 is shown fastened to the U-shaped member 10 by conventional bolts 6, 7, 8 and 9 extending through aligned holes in the lips 20 and 22 and the first L-shaped member leg 24. The first leg 14 of the U-shaped member 10 is rigidly and removably fastened to a pier member 64 by conventional bolts 100 and 102 extending through ports, such as holes 1 (shown in FIG. 1), and clamping the support housing to the pier member 64. The pier member 64 is a conventional, rigid part of a dock or other structure to which watercraft are moored. The pier member 64 has a cantilever beam 66 extending outwardly from one side, to which a first end of a cable 68 is removably attached.

A rotary motor, preferably an electric motor 34, is fastened to the support panel leg 26. A drive pulley 38 is rigidly mounted to the motor drive shaft 40 in a conventional manner. A driven pulley 42 is rigidly mounted to a worm gear shaft 44 which extends through a gap between the top edge 11 of the U-shaped member 10 and the support panel leg 26 of the L-shaped member. The gap formed between the support panel leg 26 of the L-shaped member 12 and the top edge 11 of the U-shaped member 10 is as large as necessary to permit the worm gear shaft 44 to pass through it. A drive belt 46 extends around the drive pulley 38 and the driven pulley 42. The worm gear shaft 44 and motor shaft 40 are preferably parallel to one another and perpendicular to the first gear 56.

The worm gear shaft 44 is journalled in a pair of bearings 52 and 54 which are rigidly mounted to the first leg 24 of the L-shaped member 12. A worm gear 50, preferably integral with the worm gear shaft 44, is disposed between the bearings 52 and 54. A gear 56 is rigidly fixed to an axle 60 and the radial teeth of the gear 56 intermesh with the helical teeth of the worm gear 50. Rotation of the worm gear 50 causes rotation of the gear 56 about a reel 57, which is rigidly fastened to the axle 60.

Figure 4:
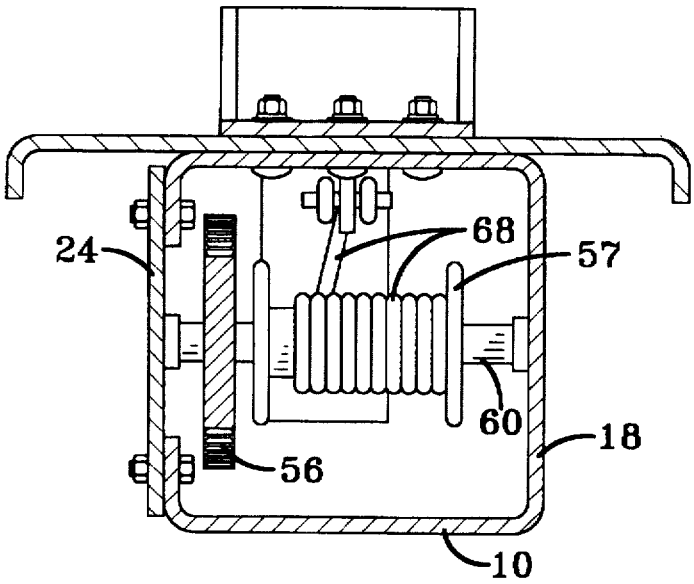
FIG. 4 is a view in section through the line 4—4 of the embodiment shown in FIG. 2.

Referring to FIG. 4, the axle 60 is rotatably mounted to the third leg 18 of the U-shaped member 10 and the first leg 24 of the L-shaped member 12. The axle 60 is preferably substantially perpendicular to the third leg 18 of the U-shaped member 10 and the first leg 24 of the L-shaped member 12, and parallel to the first and second U-shaped member legs 14 and 16.

The motor 34 is actuated to rotate its shaft 40, and the pulley 38 rotates, causing rotation of the driven pulley 42 via the drive belt 46. The pulley 42 drives the worm gear shaft 44, and therefore the worm gear 50, which rotates the gear 56 about the axle 60. As the gear 56 is driven in rotation, the attached axle 60 rotates, winding the cable 68 about the reel 57. The second end of the cable 68 is initially partially wound around the reel 57, and when the axle 60 rotates, more of the cable 68 becomes wound around the reel 57, in the manner of a winch. As the cable 68 is wound about the reel 57, a mass, such as a boat symbolized by a weight 70, is raised. The weight 70 is lowered upon reversing the motor 34.

The preferred embodiment has many advantages, such as the strength inherent in the rigidly fastened bodies assembled to form the compact support housing. The component parts are assembled in a box-beam configuration, which makes the hoist extraordinarily compact since it can contain the mechanical components at least partially within the space substantially enclosed by the legs of the housing. The mechanical components cooperate in many ways with the support housing, such as by the worm gear shaft extending through the gap formed between the U-shaped member and the L-shaped member. This configuration protects the moving parts from weather and damage from contacting other objects, yet all housed parts are easily accessed.

In addition to being compact, the configuration of the preferred embodiment is very easily assembled and disassembled which facilitates manufacture, maintenance and repair. This is the result of the relationship between the U-shaped member, the L-shaped member and the mechanical components. The worm gear 50, the pulley 42, the motor 34 and the pulley 38 are all removed from the U-shaped member by removing the four conventional hex nut bolts 6, 7, 8 and 9 fastened through the lips 20 and 22 of the U-shaped member 10. The worm gear 50 merely disengages from the gear 56. This permits ease of access to the moving parts for repair and lubrication. Additionally, the entire hoist can be removed from the pier member 64 by removing the bolts 100 and 102 (shown in FIG. 3) and removing the cable 68 from the cantilever 66.

Figure 3:
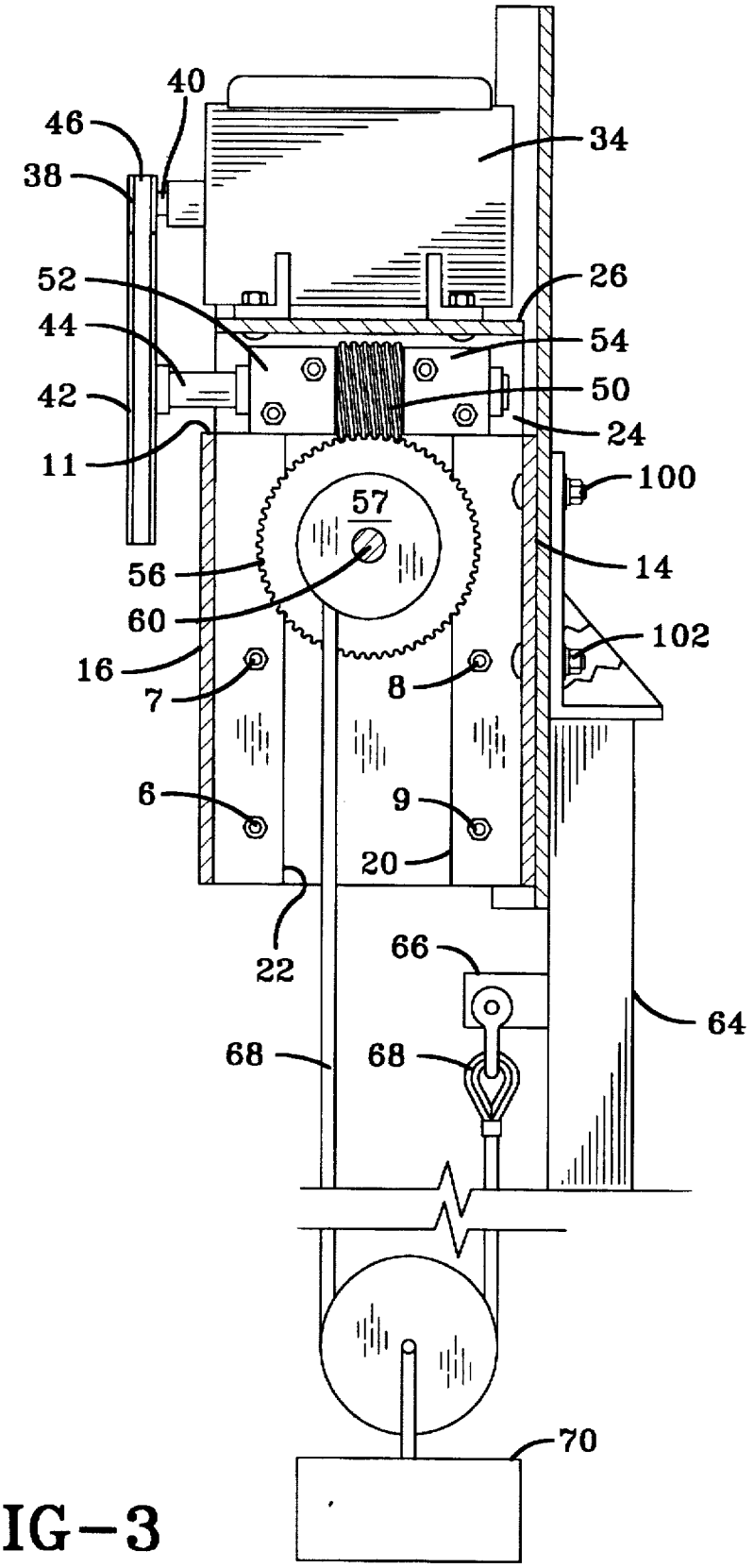
FIG. 3 is a view in section through the line 3—3 of the embodiment shown in FIG. 2.
Figure 5:
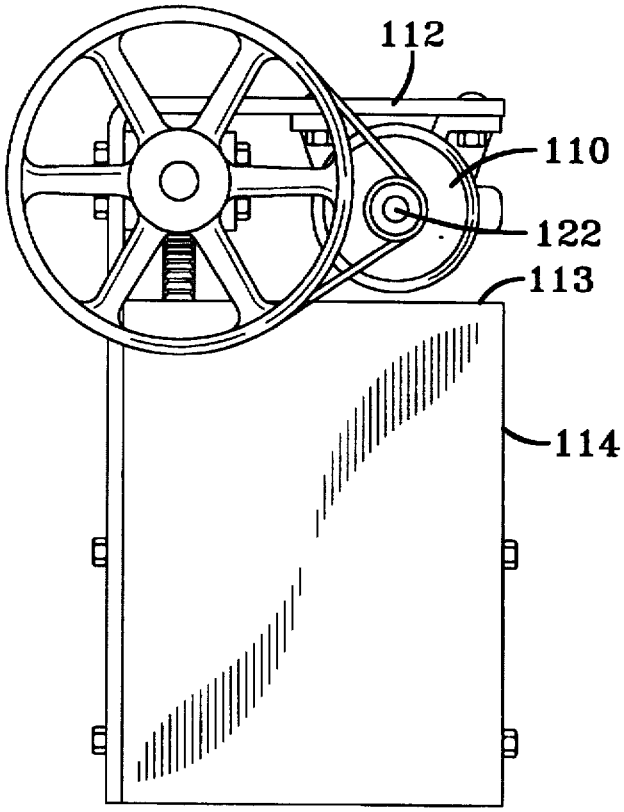
FIG. 5 is a side view illustrating an alternative embodiment of the present invention.

The motor 34 shown in FIGS. 2 and 3 is mounted on the opposite side of the L-shaped member 12 from the U-shaped member 10. It is, of course, possible to mount a motor 110 to an L-shaped member 112 on the same side as the U-shaped member 114, as shown in FIG. 5. The embodiment shown in FIG. 5 has a slight disadvantage, however, compared to the preferred embodiment. For example, the gap formed between the L-shaped member 112 and the top edge 113 of the U-shaped member 114 must be substantially larger than in the preferred embodiment, to permit the motor shaft 122 to extend through the gap.

Variations may be made to the preferred embodiment to arrive at a somewhat different structure, without departing from the principle of the invention. For example, the pulleys 38 and 42 and the drive belt 46 may be replaced with gears and a chain, respectively. Additionally, the electric motor 34 could be replaced by a gasoline engine. These variations are known in the art. While certain preferred embodiments of the present invention have been disclosed in detail, it is to be understood that various modifications may be adopted without departing from the spirit of the invention or scope of the following claims.

I claim:

1. A compact hoist comprising:

(a) a support housing including a plurality of legs joined together to form a cylinder enclosing a space on all but opposed top and bottom sides, said support housing also including a removably attached support panel extending at least partially across the top side of the support housing and a mount for attaching the support housing to a pier in an operable position in which the bottom side faces downwardly;

(b) a reel mounted at least partially within the support housing space, and fixed to a reel axle journalled to the support housing;

(c) a cable extending vertically downwardly from attachment to the reel through an opening in the bottom side;

(d) a worm gear, mounted at least partially within the support housing space to a worm gear axle journalled to the support housing;

(e) a first gear, mounted at least partially within the support housing space, fixed to the reel axle and meshing with the worm gear; and (f) a rotary motor mounted to the support panel, said motor having a driveshaft substantially parallel to the worm gear axle and drivingly linked to the worm gear axle.

2. The compact hoist in accordance with claim 1, wherein said mount comprises ports on one of the legs.

3. The compact hoist in accordance with claim 1, wherein the support housing comprises:

(a) a U-shaped support housing member having first and second legs connected by a third leg near a first side, said U-shaped member having an opposite, open side; and (b) said removably attached support panel comprises an L-shaped support housing member having a first leg fastened across the open side of the U-shaped member to form the cylinder, and a support panel leg extending at least partially across the top side of the cylinder, wherein said reel axle is journalled, and substantially perpendicular, to the first leg of the L-shaped member and the third leg of the U-shaped member.

4. A hoist in accordance with claim 3, wherein a gap is formed between the support panel leg of the L-shaped member and the U-shaped member, and the worm gear axle extends therethrough.

5. A hoist in accordance with claim 4, wherein a pulley is rigidly mounted to the worm gear axle, a pulley is rigidly mounted to the motor's driveshaft, and an endless loop drive belt extends around at least a portion of both pulleys.

6. A hoist in accordance with claim 3, wherein the motor is mounted to a surface of the support panel leg of the L-shaped member, and said surface faces away from the U-shaped member.

7. A hoist in accordance with claim 3, wherein the motor is mounted to a surface of the support panel leg of the L-shaped member, and said surface faces toward the U-shaped member.

8. A hoist in accordance with claim 3, wherein the first leg of the L-shaped member closes the open side of the U-shaped member.

* * * * *